US010856631B1

(12) United States Patent
Schulhofer

(10) Patent No.: US 10,856,631 B1
(45) Date of Patent: Dec. 8, 2020

(54) DEVICE, SYSTEM, AND METHOD FOR WIRELESSLY CONTROLLING AN ARRAY OF BEACH UMBRELLAS

(71) Applicant: Joerg Schulhofer, Pirka (AT)

(72) Inventor: Joerg Schulhofer, Pirka (AT)

( * ) Notice: Subject to any disclaimer, the term of this patent is extended or adjusted under 35 U.S.C. 154(b) by 0 days.

(21) Appl. No.: 16/834,571

(22) Filed: Mar. 30, 2020

(51) Int. Cl.

| | |
|---|---|
| ***A45B 25/14*** | (2006.01) |
| ***A45B 25/02*** | (2006.01) |
| *A45B 25/18* | (2006.01) |
| *A45B 25/00* | (2006.01) |

(52) U.S. Cl.
CPC ..... *A45B 25/143* (2013.01); *A45B 25/02* (2013.01); *A45B 25/18* (2013.01); *A45B 2025/003* (2013.01); *A45B 2200/1027* (2013.01)

(58) Field of Classification Search
CPC ..... A45B 25/14; A45B 15/143; A45B 25/143
See application file for complete search history.

(56) References Cited

U.S. PATENT DOCUMENTS 2,960,094 A * 11/1960 Small ..... A45B 25/14 135/22
4,884,506 A * 12/1989 Guerreri ..... F42C 11/06 102/200
5,987,818 A * 11/1999 Dabideen ..... E05B 63/22 49/280
6,404,079 B1 * 6/2002 Hsieh ..... F21V 23/04 307/117
7,188,633 B2 * 3/2007 Zerillo ..... A45B 25/143 135/16
7,614,600 B1 * 11/2009 Smith ..... G09F 23/00 135/16
9,713,368 B1 * 7/2017 Kuelbs ..... A45B 25/143
10,078,856 B2 * 9/2018 Gharabegian ..... A45B 17/00
10,159,316 B2 * 12/2018 Gharabegian ..... H02S 30/20
2004/0055627 A1 * 3/2004 P. Moga ..... A45B 25/165 135/16

OTHER PUBLICATIONS

Sorara, "TrueShade Plus Remote Control Market Umbrella with Sunbrella Fabric, Lights, Remote Control, Storage Cover—Freestanding or Table Hole.—9' Diameter Canvas—Jockey Red", downloaded from https://www.amazon.com/TrueShade-Control-Umbrella-Sunbrella-Storage/dp/B01DCKRMG4 on Feb. 6, 2020, pp. 1-2.

* cited by examiner

*Primary Examiner* — Noah Chandler Hawk
(74) *Attorney, Agent, or Firm* — The Concept Law Group, PA; Scott D. Smiley; Scott M. Garrett

(57) ABSTRACT

An array of wirelessly controllable umbrellas includes at least two umbrellas with receivers and with motors operable to open and close the umbrellas. The receivers are operable to wirelessly receive a code and communicate with the motors to open or close the umbrellas based on an authentication of the code being an authorized code and to deny operation of the umbrella based on receipt of an unauthorized code.

20 Claims, 11 Drawing Sheets

1400

DEVICE, SYSTEM, AND METHOD FOR WIRELESSLY CONTROLLING AN ARRAY OF BEACH UMBRELLAS

FIELD OF THE INVENTION

The present invention relates generally to umbrellas, and, more particularly, relates to automated opening and closing and other functions of large beach-type umbrellas.

BACKGROUND OF THE INVENTION

Umbrellas are ubiquitous. Virtually every person owns at least one. Most are of the lightweight portable type that one would carry around to shield themselves from rain or sun. These umbrellas have simple lightweight mechanisms for opening and folding and are generally performed by a user simply moving the structure from one position to the other or pushing a button that utilizes a spring for doing the same. In typical use, the user would open a portable umbrella for a short period of use, and then would close it for storage wherever the user selects, e.g., their car or office.

Another common type of umbrella is the much larger structure one would find at a beach or a pool. These umbrellas, although portable, require a great deal of strength to manage their weight and size. Often times, the installation or placement of these umbrellas is performed by someone who is a staff member or paid worker at one of these beaches or pools. In addition, many times, these umbrellas remain in a fixed position and are rarely moved. For example, it is quite frequent to find a large array of these umbrellas on the beach behind a hotel. Although the same umbrellas can be found at a pool, throughout this application these large umbrellas will be referred to as "beach umbrellas." The term, as used herein, is intended to also refer to umbrellas used at a pool and other umbrellas of similar structure, i.e., larger than the portable type.

Although there are several reasons to use a beach umbrella, the most common use of a beach umbrella is to shield the user from the sun. Conveniently, these beach umbrellas can be opened and closed as desired by the user or the owner of the beach umbrellas. Typically, the owner of the umbrellas, e.g., the owner of the hotel or pool, will want the umbrellas to be closed during the evening and opened during the day. This is mainly because the umbrellas provide a large resistance to wind when opened and much less resistance when closed. Closing the umbrellas at night greatly reduces the probability that a strong gust of wind will displace the umbrella. Not only can an umbrella displaced by the wind damage the umbrella, they can also damage other objects and people that are in its path. For this reason, it is extremely common for the umbrella owners to close them at night. In addition, the user of the umbrella frequently will close it so that they can get some sun on their skin and will then open it to provide shade or possible protection from rain.

Beach umbrellas are typically rather large structures. With the large structure comes larger weight, which makes it more difficult to open and close than the typical portable type described above. FIG. 1 shows one example of the underlying structure 101 of a prior art beach umbrella 100. More specifically, the prior art beach umbrella 100 is supported by a base 102. The base 102 can be a foot structure or can be the ground, e.g., the end of the umbrella 100 is inserted into beach sand, dirt, or other material that will support the umbrella 100. A purpose of the base 102 is to support an upwardly extending support pole 104 that ends with a pole cap 118, which protects the end of the support pole 104. Coupled to an upper portion 106 of the support pole 104 is an upper support ring 108. Although it is referred to herein as a "ring," it is not always ring shaped or round. The upper support ring 108 is coupled to a plurality of sunshade support posts 110 extending therefrom. The sunshade support posts 110, together form a foundation and are used to couple to and support whatever material is used to provide the barrier between the user of the beach umbrella 100 and the sun. This material is typically a canvas material, but other materials are used as well.

The support posts 110 have attached at a location near their center 112 a corresponding plurality of lift posts 114. Each of the lift posts 114 is rotatably coupled to the support posts 110 at a first end thereof so that the lift posts 114 and the support posts 110 can move angularly independently of one another. All of the lift posts 114 are attached at a second end thereof to a support pole ring 116. The coupling between the second end of the lift posts 114 and the support ring 116 it is also a rotatable connection. In operation, when the support pole ring 116 is moved along the support pole 104 in a direction toward the upper support ring 108, the lift posts 114 are moved upwardly. Because the lift posts 114 are coupled to the support posts 110 at location 112, the upward movement of the lift posts causes a corresponding movement in the support posts 110. The support posts 110, however, are anchored at their upper end by the upper support ring 108. As a result, the ends of the support posts 110 opposite the end that is coupled to the upper support ring 108 moves upwardly and outwardly, which opens up the umbrella and maximizes the surface area of the sunshade.

There are two main methods for moving the support pole ring 116 upwardly toward the upper support ring 108. The first is to simply manually lift the support pole ring 116. Beach umbrellas that are designed for this type of opening typically will have a hole drilled in the support pole 104 near its upper end and will supply a pin that can be inserted into said hole. Once the support pole ring 116 is lifted above the hole, the pin is inserted and will retain the support pole ring 116 in the raised position for as long as desired. The problem with this type of umbrella opening mechanism is that it requires a great deal of physical strength, as the person moving the support pole ring 116 upwardly must reach inside of the support posts 110, which will be covered with the sunshade material and typically requires the user to bend down and crawl inside, and lift all of the weight of the support posts 110 and sunshade material upwardly. This is not an easy task. Added to this, it is not uncommon for a beach to have dozens if not hundreds of beach umbrellas that need to be opened each morning and closed each evening. Opening the umbrella with sheer human strength is not ideal, particularly in large-scale operations.

A second and probably more popular method for opening large beach umbrellas is through the use of a crank 202, as shown in FIG. 2. The crank 202 is located on a location along the support pole 104. Typically, the crank 202 is coupled to a cable 204 that has a portion that runs inside of the support pole 104 and a portion that extends out of support pole 104 and is coupled to the support pole ring 116. When the crank 202 is turned, the portion of the cable 204 that is present inside the support pole 104 is either shortened or lengthened, depending on which way the crank 202 is being turned. If the umbrella 100 is in a closed position, such as that shown in FIG. 2, the crank 202 will be used to shorten the cable 204. As the cable 204 shortened, it pulls the support pole ring 116 upwardly along the support pole 104, as shown in FIG. 3, and causes the support posts 110 to expand, as explained in the paragraphs above. Likewise, when the crank 202 is turn the opposite direction, the cable will extend and allow the support pole ring 116 to move downwardly, away from the upper support ring 108, and will allow the umbrella to close, as is depicted in FIG. 2. Although turning the crank is usually a much easier task than manually lifting the support pole ring 116, it is still a time-consuming and arduous task; particularly, in applications where there are dozens to hundreds of umbrellas that need to be opened in the morning and closed at night, not to mention all of the movement of these umbrellas desired by the users of the umbrellas throughout the day.

Therefore, a need exists to overcome the problems with the prior art as discussed above.

SUMMARY OF THE INVENTION

The invention provides a device, system, and method for wirelessly controlling an array of beach umbrellas, which overcomes the hereinafore-mentioned disadvantages of the heretofore-known devices and methods of this general type and that allows each umbrella to be self-powered/self-charging.

With the foregoing and other objects in view, there is provided, in accordance with the invention, an array of wirelessly controllable umbrellas that includes a wireless transmitter and a plurality of umbrellas, where each umbrella has a pole engagement member shaped and sized to couple to a distal end of an umbrella pole, an umbrella cord length control unit supported by the pole engagement member and operable to alter a length of an umbrella cord to open and close the umbrella, a wireless receiver operable to receive wireless signals transmitted by the wireless transmitter and cause the umbrella cord length control unit to alter the length of the umbrella cord upon wirelessly receiving an instruction to do so, a power source electrically coupled to and operable to supply power to the umbrella cord length control unit, and a solar energy collection panel electrically coupled to and operable to supply power to the power source. The array also includes a first decoder coupled to a first umbrella in the plurality of umbrellas, the first decoder communicatively coupled to the umbrella cord length control unit of the first umbrella in the plurality of umbrellas and operable to prevent the umbrella cord length control unit of the first umbrella in the plurality of umbrellas from shortening the length of the umbrella cord unless a first predesignated code is received by the wireless receiver of the first umbrella in the plurality of umbrellas and a second decoder coupled to a second umbrella in the plurality of umbrellas, the second decoder communicatively coupled to the umbrella cord length control unit of the second umbrella in the plurality of umbrellas and operable to prevent the umbrella cord length control unit of the second umbrella in the plurality of umbrellas from shortening the length of the umbrella cord unless a second predesignated code, that is different from the first predesignated code, is received by the wireless receiver of the second umbrella in the plurality of umbrellas.

In accordance with another feature, an embodiment of the present invention includes a transmitter coupled to the first umbrella in the plurality of umbrellas and operable to report at least one condition, including at least an open status of the umbrella.

In accordance with a further feature of the present invention, the wireless transmitter is communicatively coupled to the internet and transmits signals initiated over the internet.

In accordance with a further feature of the present invention, each of the plurality of umbrellas includes a wireless repeater operable to transmit to other umbrellas within the array of umbrellas a copy of a signal received by the wireless receiver.

In accordance with a further feature of the present invention, the wireless repeater is operable to facilitate an internet connection for one or more wireless communication devices proximate to the array of umbrellas.

In accordance with a yet another feature of the present invention, a wind turbine is electrically coupled to and operable to supply power to the power source.

In accordance with a further feature of the present invention, a camera is coupled to at least one of the plurality of umbrellas and a processor is coupled to the camera and operable determine a match between an image captured by the camera and a pre-stored image of a person.

In accordance with one more feature of the present invention, the processor is operable to cause the umbrella cord length control unit that is coupled to the at least one of the plurality of umbrellas to alter the length of the umbrella cord when a match between the image captured by the camera and the pre-stored image of the person is detected.

In accordance with another feature, a wind detector is operable to sense wind gusts and cause the umbrella cord length control unit that is coupled to the at least one of the plurality of umbrellas to alter the length of the umbrella cord when a wind gust above a predetermined level is detected.

A system of one or more smart umbrellas can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method of activating an umbrella within an array of wirelessly controllable umbrellas providing a plurality of umbrellas, each umbrella having a pole engagement member shaped and sized to couple to a distal end of an umbrella pole; an umbrella cord length control unit supported by the pole engagement member and operable to alter a length of an umbrella cord to open and close the umbrella; a wireless receiver operable to receive wireless signals transmitted by the wireless transmitter and cause the umbrella cord length control unit to alter the length of the umbrella cord upon wirelessly receiving an instruction to do so; a decoder coupled to the umbrella cord length control unit and operable to prevent the umbrella cord length control unit from shortening the length of the umbrella cord; a power source electrically coupled to and operable to supply power to the umbrella cord length control unit; and a solar energy collection panel electrically coupled to and operable to supply power to the power source; and a wireless transmitter; and transmitting via the wireless transmitter a first code that is received by the wireless receiver of a first umbrella in the plurality of umbrellas. The method of activating also includes decoding by the decoder of the first umbrella in the plurality of umbrellas the first code. The method of activating also includes causing the first umbrella in the plurality of umbrellas to open; transmitting via the wireless transmitter a second code that is different from the first code and is received by the wireless receiver of a second umbrella in the plurality of umbrellas, decoding by the decoder of the second umbrella in the plurality of umbrellas the second code. The method of activating also includes causing the second umbrella in the plurality of umbrellas to open. Other embodiments of this aspect include corresponding computer systems, apparatus, and computer programs recorded on one or more computer storage devices, each configured to perform the actions of the methods.

Implementations may include one or more of the following features. The method may include the steps of reporting, with a first transmitter coupled to the first umbrella in the plurality of umbrellas, at least one condition of the first umbrella, including at least an open status of the first umbrella; and reporting, with a second transmitter coupled to the second umbrella in the plurality of umbrellas, at least one condition of the second umbrella, including at least an open status of the second umbrella. The method where the wireless transmitter is communicatively coupled to the internet and transmits signals initiated over the internet. The method may include the step of transmitting, by a first umbrella within the plurality of umbrellas, a copy of the wireless signals transmitted by the wireless transmitter to at least a second umbrella within the plurality of umbrellas. The method may include the steps of providing a wireless repeater coupled to at least one umbrella in the array of umbrellas; and facilitating, through the at least one wireless repeater, an internet connection for one or more wireless communication devices proximate to the array of umbrellas. The method may include the step of coupling a wind turbine to at least one umbrella in the array of umbrellas, the wind turbine operable to supply power to the power source. The method may include the step of providing a camera coupled to at least one of the plurality of umbrellas; providing a processor coupled to the camera; and determining with the processor a match between an image captured by the camera and a pre-stored image of a person. The method may include causing the umbrella cord length control unit that is coupled to the at least one of the plurality of umbrellas to alter the length of the umbrella cord after the determining step. The method may include detecting, with a wind detector, wind gusts that exceed a predetermined threshold level; and causing the umbrella cord length control unit that is coupled to the at least one of the plurality of umbrellas to alter the length of the umbrella cord. device, system, and method for wirelessly controlling an array of beach umbrellas abstract of the disclosure an array of wirelessly controllable umbrellas includes at least two umbrellas with receivers and with motors operable to open and close the umbrellas. the receivers are operable to wirelessly receive a code and communicate with the motors to open or close the umbrellas based on an authentication of the code being an authorized code and to deny operation of the umbrella based on receipt of an unauthorized code. Implementations of the described techniques may include hardware, a method or process, or computer software on a computer-accessible medium.

Although the invention is illustrated and described herein as embodied in a device, system, and method for wirelessly controlling an array of beach umbrellas, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean a direction corresponding to an elongated direction of the mechanical member being referenced. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system. Those skilled in the art can understand the specific meanings of the above-mentioned terms in the embodiments of the present invention according to the specific circumstances.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
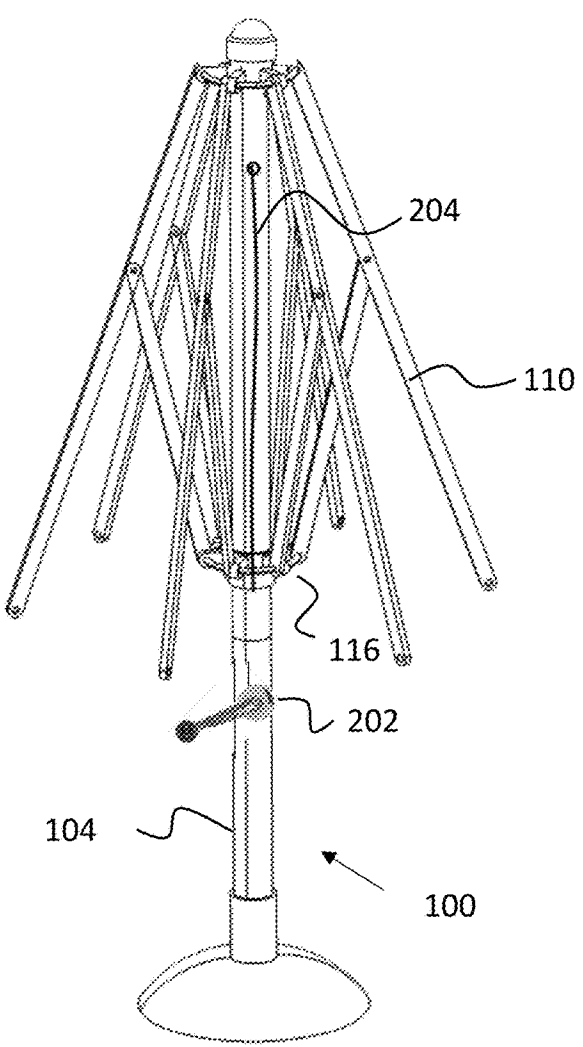
FIG. 2 (Prior Art)
FIG. 2 is a perspective view of a prior art beach umbrella frame with a crank handle for opening and closing the umbrella, shown in a closed position.
Figure 1:
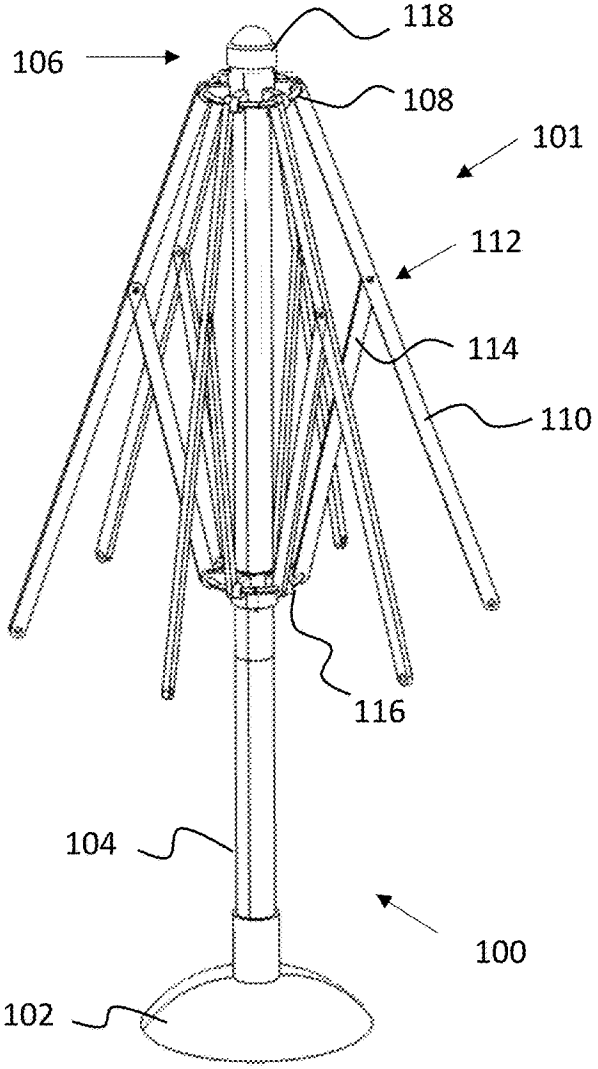
FIG. 1 (Prior Art)
FIG. 1 is a perspective view of a prior art beach umbrella frame with a member that can be manually moved along a support pole to open and close the umbrella.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient device, system, and method for wirelessly controlling an array of beach umbrellas. Embodiments of the invention provide each beach umbrella with an end node wireless receiver and renewable energy source for ensuring each umbrella reliably has sufficient power to receive and interpret wireless signals and to open, close, or perform one of many other functions on command. In addition, embodiments of the invention provide devices that are attractive, durable, and sufficiently sized to protect its users from the sun or other elements.

Figure 4:
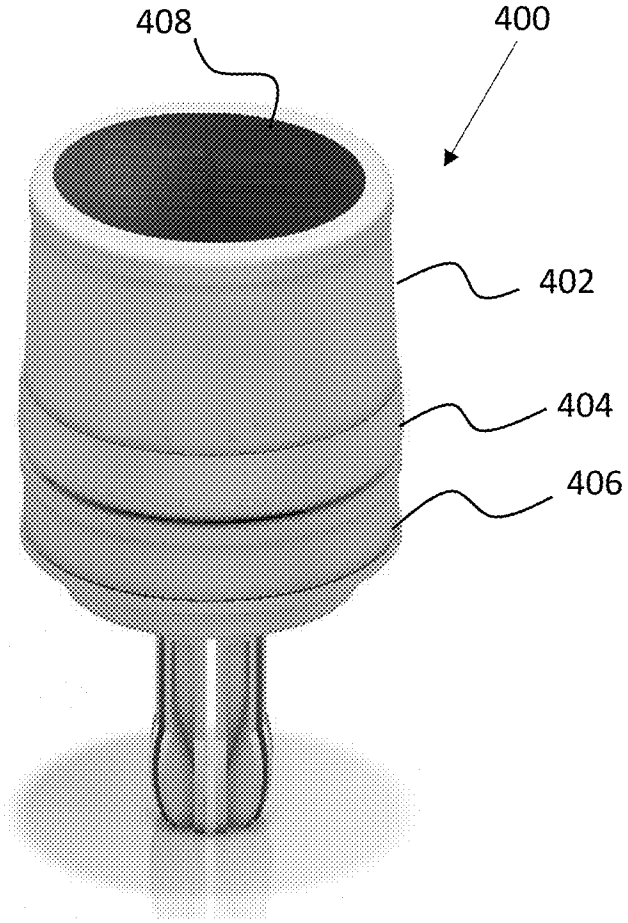
FIG. 4 is a downward-looking perspective view of a control head in accordance with an embodiment of the present invention.
Figure 3:
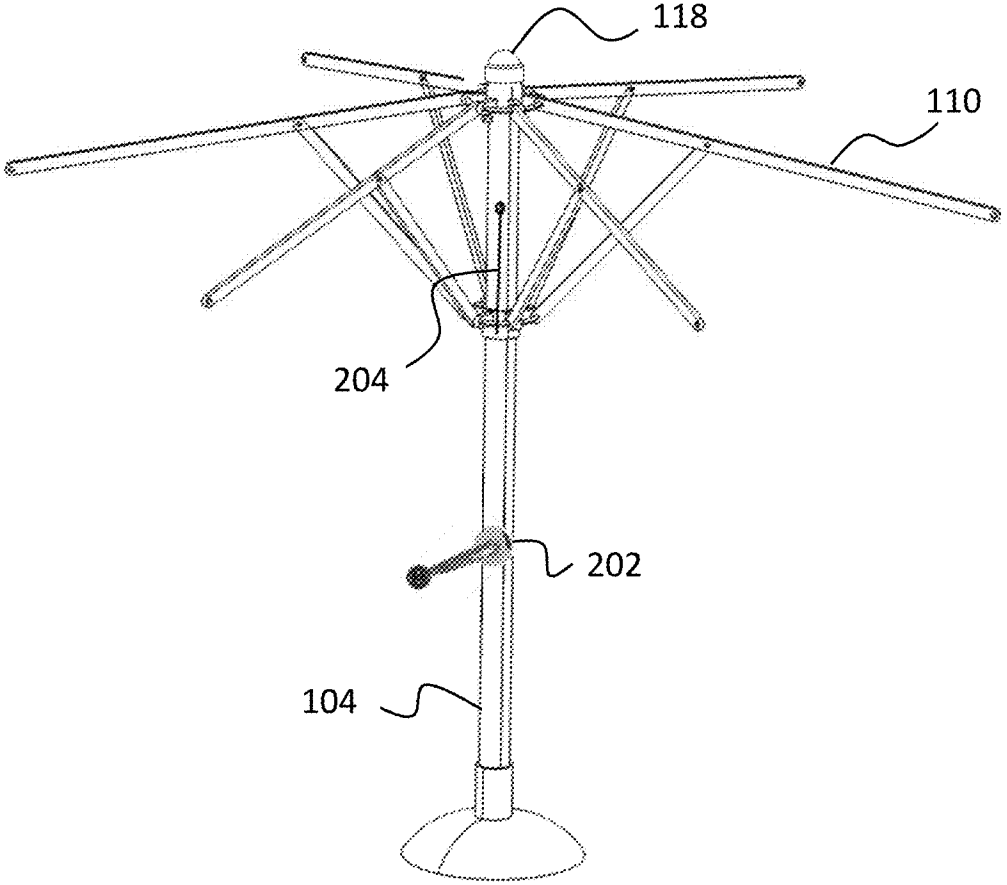
FIG. 3 (Prior Art)
FIG. 3 is a perspective view of the prior art beach umbrella frame with a crank handle of FIG. 2, shown in an open position.

Referring now to FIG. 4, one embodiment of the present invention is shown in a perspective downward-looking view. FIG. 4 shows several advantageous features of the present invention, but, as will be described below, the invention can be provided in several shapes, sizes, combinations of features and components, and varying numbers and functions of the components. The first example of a retrofitting umbrella control head 400 is shown in FIG. 4.

Control head 400 includes three main sections. The first section is the pole engagement member 406, which is shaped and sized to fit within and couple to a distal, i.e., upper, end of an umbrella pole. Coupled to the pole engagement member 406 is the mechanical gear platform 404, which supports the gearing, motor, and electronics that will all be described below. Finally, a housing 402 is coupled to and located on a side of the gear platform 404 that is opposite to the pole engagement member 406. The housing 402 covers and protects the internal components of the control head 400. Notably, the housing 402 includes within it a solar panel 408, which collects power and stores it within an energy storage component housed within the control head 400.

Figure 6:
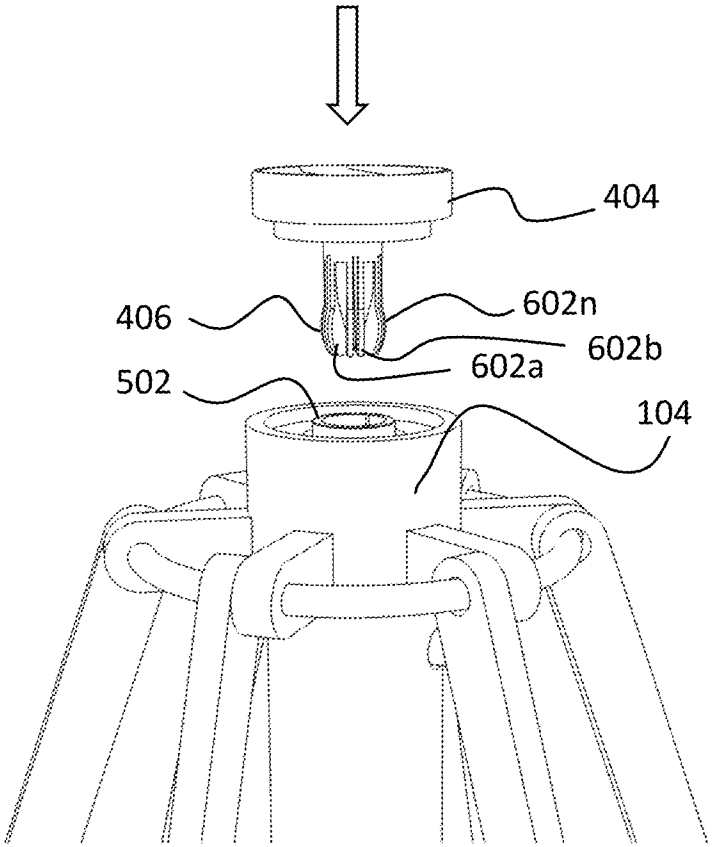
FIG. 6 is a downward-looking perspective view of the pole engagement members of a control head being inserted into the upper portion of the beach umbrella of FIG. 5, in accordance with an embodiment of the present invention.
Figure 5:
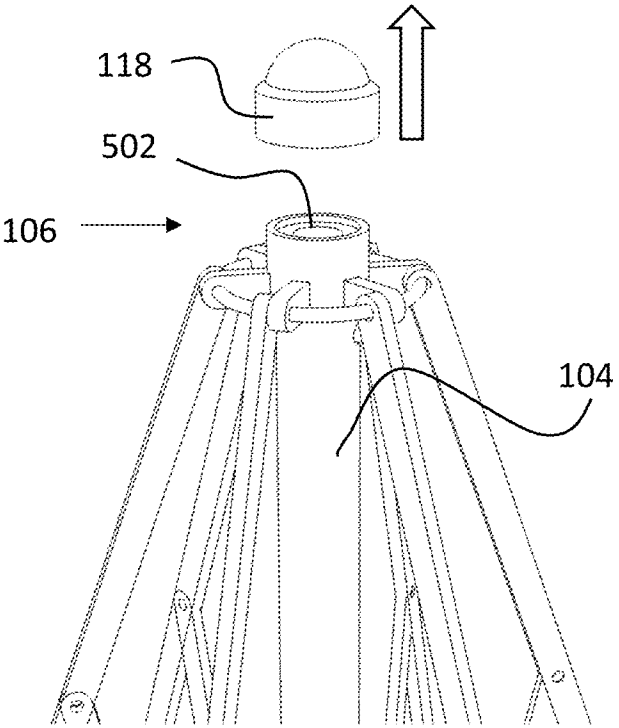
FIG. 5 is a downward-looking perspective view of a prior-art beach umbrella showing the removal of a prior-art pole cap, in accordance with an embodiment of the present invention.

FIGS. 5 and 6 provide an illustration of how the control head 400 can be used to retrofit an existing umbrella and provide to it all of the advantages of the present invention. The present invention, however, is in no way limited to only retrofitting existing umbrellas and can be provided as a brand new product or part of a brand new product. Looking first at FIG. 5, the pole cap 118 of an existing umbrella is removed from the upper portion 106 of the support pole 104. Once the pole cap 118 is removed, it exposes an internal cavity 502 within the support pole 104. The pole cap 118 is then discarded.

Turning now to FIG. 6, the pole engagement member 406 of the control head 400 is shown being inserted within the internal cavity 502 of the support pole 104. The pole engagement member 406 has, in one embodiment of the present invention, a plurality of engagement fingers 602*a-n* (where "n" is any number greater than "a") that extend outwardly and place frictional pressure on an internal surface of the sleeve creating the internal cavity 502 of the support pole 104. This friction serves to hold and secure the pole engagement member 406 as well as the entire control head 400. The engagement fingers 602*a-n* can be spring biased in order to accommodate internal cavities 502 of varying dimensions. In addition, the control head 400 can be provided with one or more internal cavity filler sleeves that fill the cavity 502 and create tight fit for the lower insertion section 406.

Figure 17:
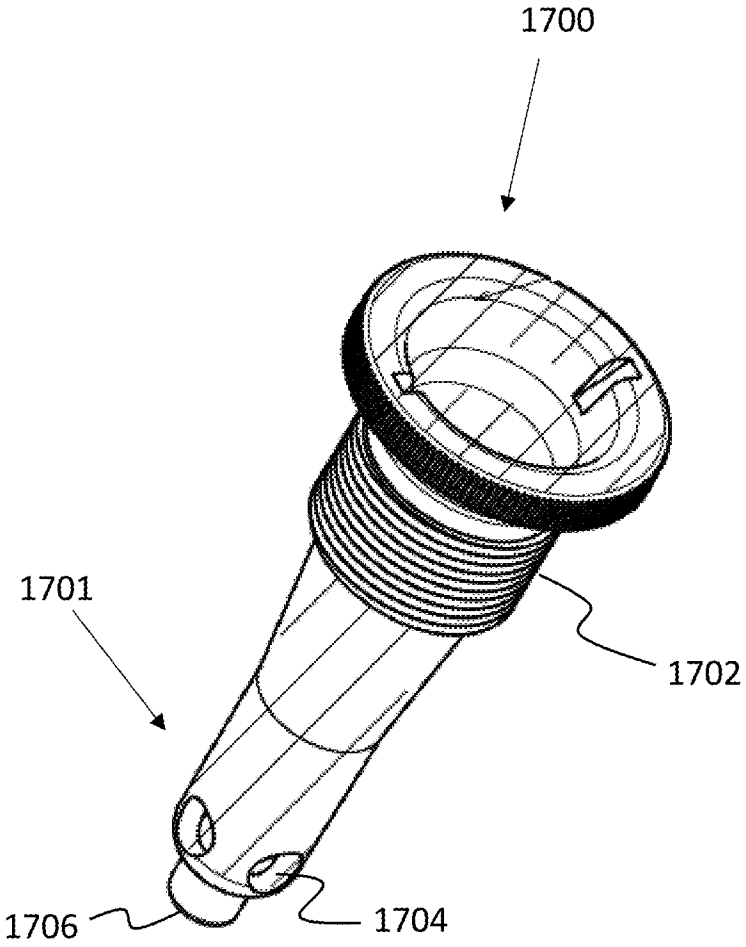
FIG. 17 is a downward-looking perspective view of an internal core that fits within the pole engagement members of FIG. 6, in accordance with an embodiment of the present invention.
Figure 20:
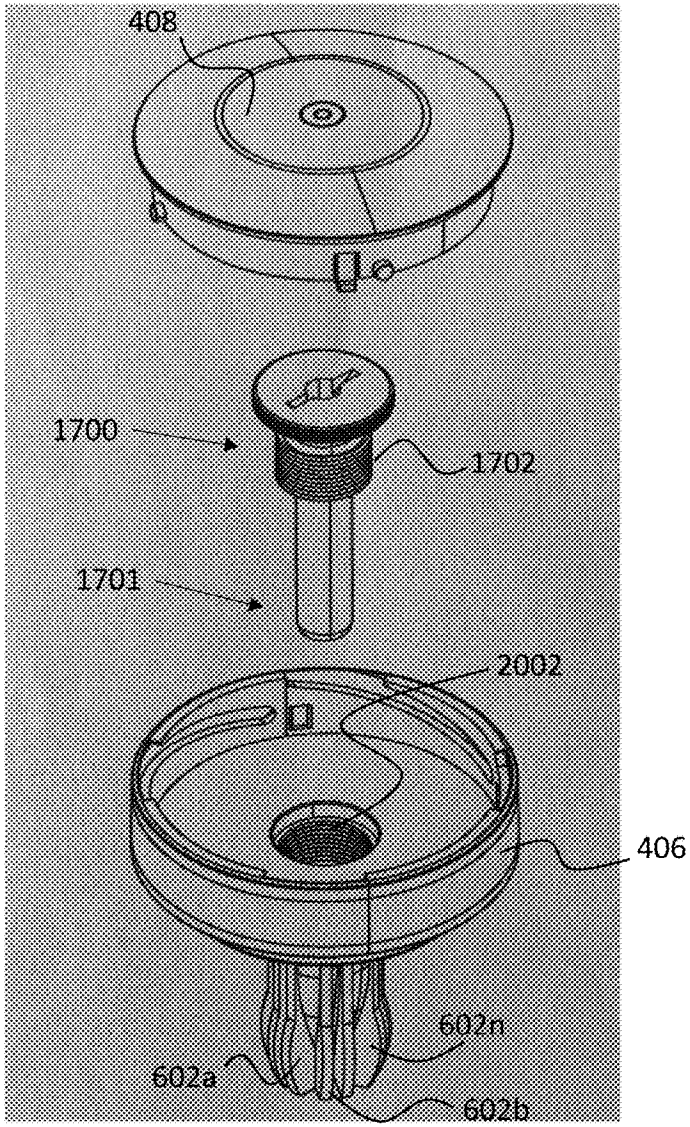
FIG. 20 is a flowchart diagram of a method of activating an umbrella within an array of wirelessly controllable umbrellas.

One feature that makes the present invention particularly advantageous is the ease upon which it is attached to an existing umbrella. Because the engagement fingers 602*a-n* are flexible, they are sized to fit within the support pole 104 and then flex outwardly to press against and engage with the interior surface of the support pole in a way that does not allow the control head 400 to be removed. This is facilitated with the help of an internal core 1700 that is shown in FIG. 17. The internal core 1700 is provided with a set of external threads 1702 that match up to and mate with a set of internal threads 2002 (shown in FIG. 20) within pole engagement member 406 (shown in FIG. 4, but threads are not illustrated). The threads 1702 allow the internal core 1700 to be securely inserted within and through the pole engagement member 406. As the internal core 1700 is screwed into the pole engagement member 406, a distal end 1701 of the core 1700 is increasingly forced into an internal cavity formed by and in between the engagement fingers 602*a-n*. As the distal end 1701 of the core 1700 is inserted further and further into the cavity between the fingers 602*a-n*, the fingers 602*a-n* are increasingly spread apart from one another, i.e., are pushed outwardly. This outward travel creates a tight frictional grip between the fingers 602*a-n* and the internal cavity 502 of the support pole 104. The core 1700 therefore provides a quick, simple, and solid coupling between the fingers 602*a-n* and the internal cavity 502 of the support pole 104 that allows the present invention to be quickly and easily installed (mounted or removed) onto most existing umbrellas.

The distal end 1701 of the core 1700 can be provided with a first hole 1704 and a second hole 1706. Either of the holes conveniently allow structures to pass from within the control head 400 to other parts of the umbrella, namely into the internal cavity 502 of the support pole 104. For instance, an umbrella cord 702 (shown in FIG. 7) can pass through the second hole 1706 to the gears within the control head 400. Other cords, such as a USB cord 1608 (shown in FIG. 16) can pass through a first hole 1704. The USB cord can be used to couple a music player to a speaker 1604 (also shown in FIG. 16), to charge a battery of a user's device, to install software updates to the control head 400, and much more.

Figure 7:
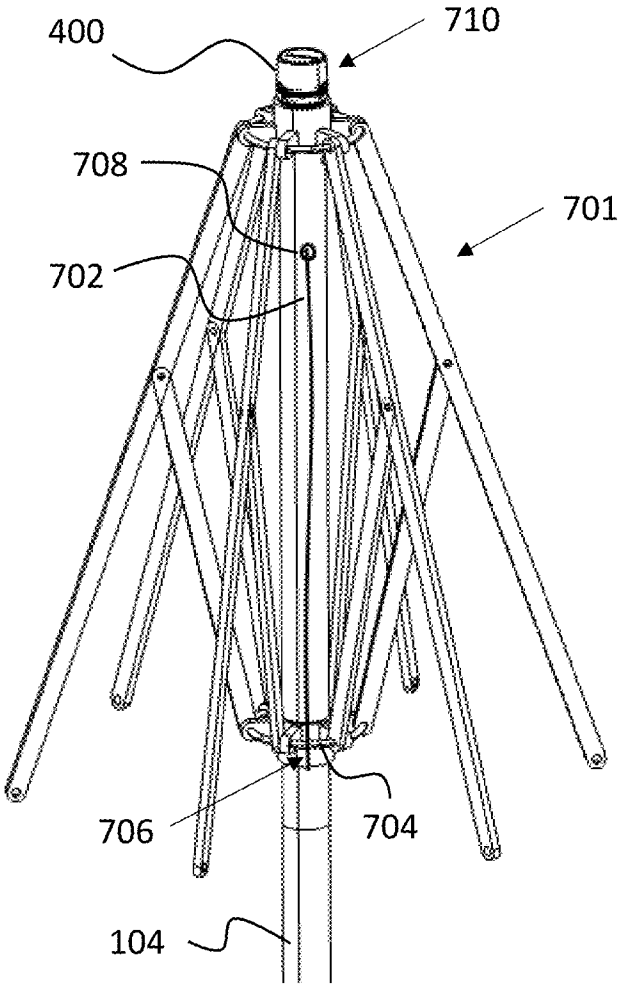
FIG. 7 is a downward-looking perspective view showing the control head of FIG. 4 inserted into the upper portion of the beach umbrella of FIG. 5, in accordance with an embodiment of the present invention.

Turning now to FIG. 7, an umbrella cord 702 is shown spanning from a lower movable portion 706 of the underlying structure 701 of the beach umbrella up and through an entry point 708 in the support pole 104. The entry point 708 is near the distal end 710 of the support pole 104. Not visible in FIG. 7, the umbrella cord 702 continues upward within the support pole 104 and enters an umbrella cord length control unit located within the umbrella control head 400. The umbrella cord 702 is coupled to a ring 704 at the lower movable position 706 of the underlying structure 701. When the umbrella cord 702 is shortened, the ring 704 is pulled in a direction toward the distal (upper) end of the support pole 104, i.e., toward the entry point 708. As it does this, the underlying structure 701 is lifted upward and opens outwardly. Advantageously, the inventive umbrella does not need any stop mechanisms, as internal circuits/software recognize a specified current level and know to stop operation. When the umbrella cord 702 is lengthened, the ring 704 is allowed to slide in a downward direction along the support pole 104, which causes the underlying structure 701 to fold down and inwardly.

Figure 8:
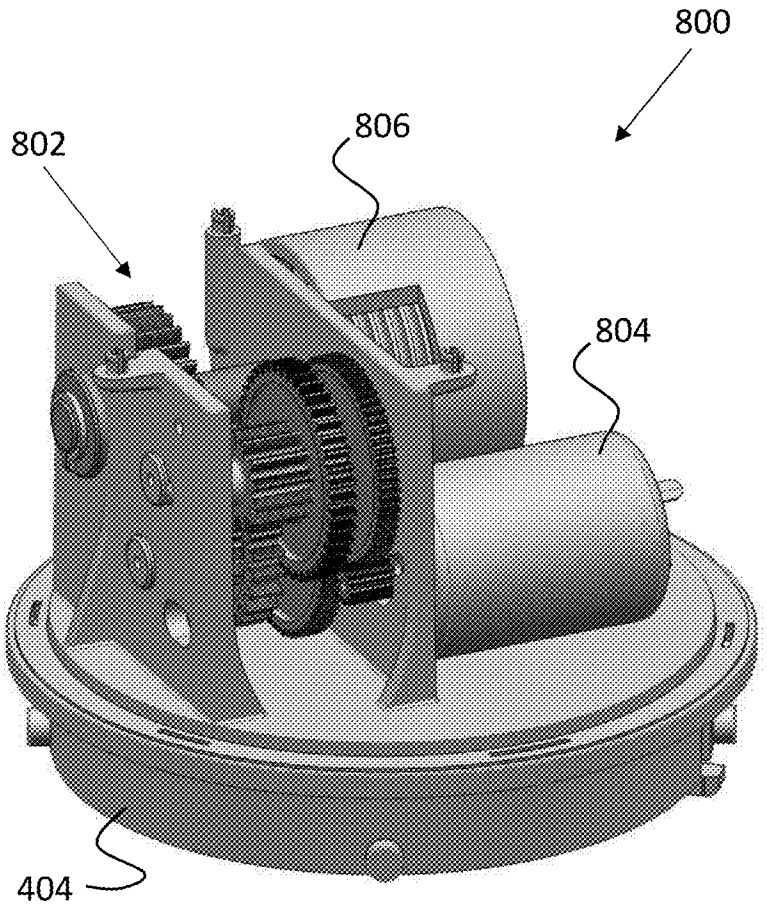
FIG. 8 is a downward-looking perspective view of an umbrella cord length control unit supported by a mechanical gear platform, in accordance with an embodiment of the present invention.

FIG. 8 shows an umbrella cord length control unit 800 supported by the mechanical gear platform 404, which is itself supported by/above the pole engagement member 406 (not shown in this view). The umbrella cord length control unit 800 is operable to alter a length of an umbrella cord 702 to open and close the underlying structure 701 of the umbrella. The umbrella cord length control unit 800 includes three main components, a set of gears 802, a motor 804, and an umbrella cord retraction/extension structure 806. When in operation, the motor 804 manipulates the gears 802, which causes the umbrella cord retraction/extension structure 806 to rotate in one of two directions.

Figure 9:
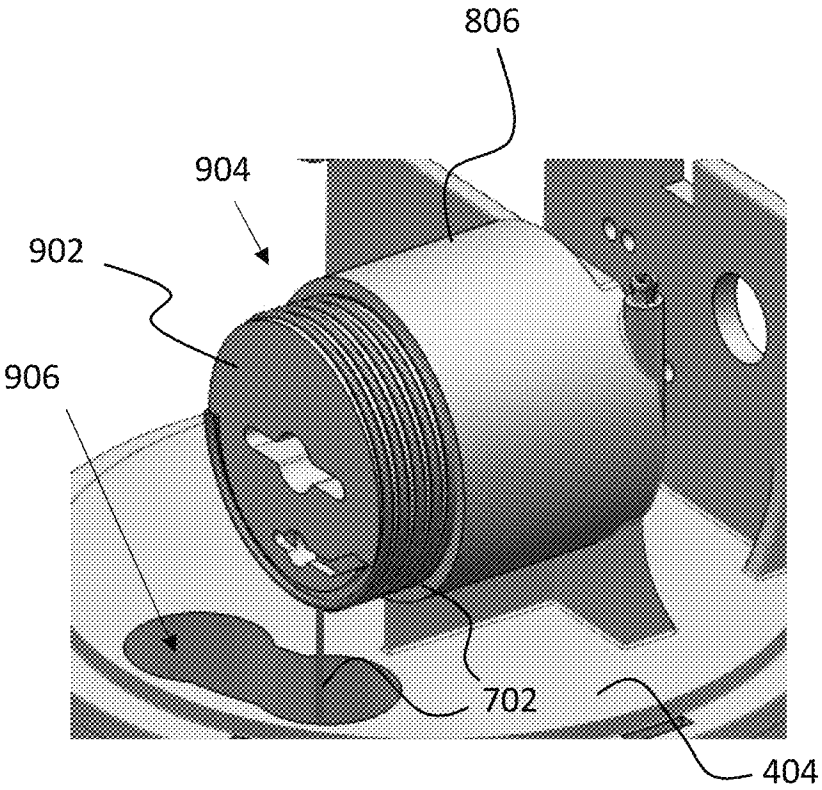
FIG. 9 is a fragmentary close-up perspective view of an umbrella cord retraction/extension structure in accordance with the present invention.

Looking now to FIG. 9, a close-up perspective view of the umbrella cord retraction/extension structure 806 is shown. The umbrella cord retraction/extension structure 806 includes an umbrella cord winding structure 902 that is provided with a set of helical grooves 904. Shown within the helical grooves 904 is a portion of the umbrella cord 702. The helical grooves 904 provide a seat for the umbrella cord 702 as the umbrella cord winding structure 902 is rotated and takes up the umbrella cord 702. The mechanical gear platform 404 has within it an opening 906 through which the umbrella cord 702 passes.

Figure 10:
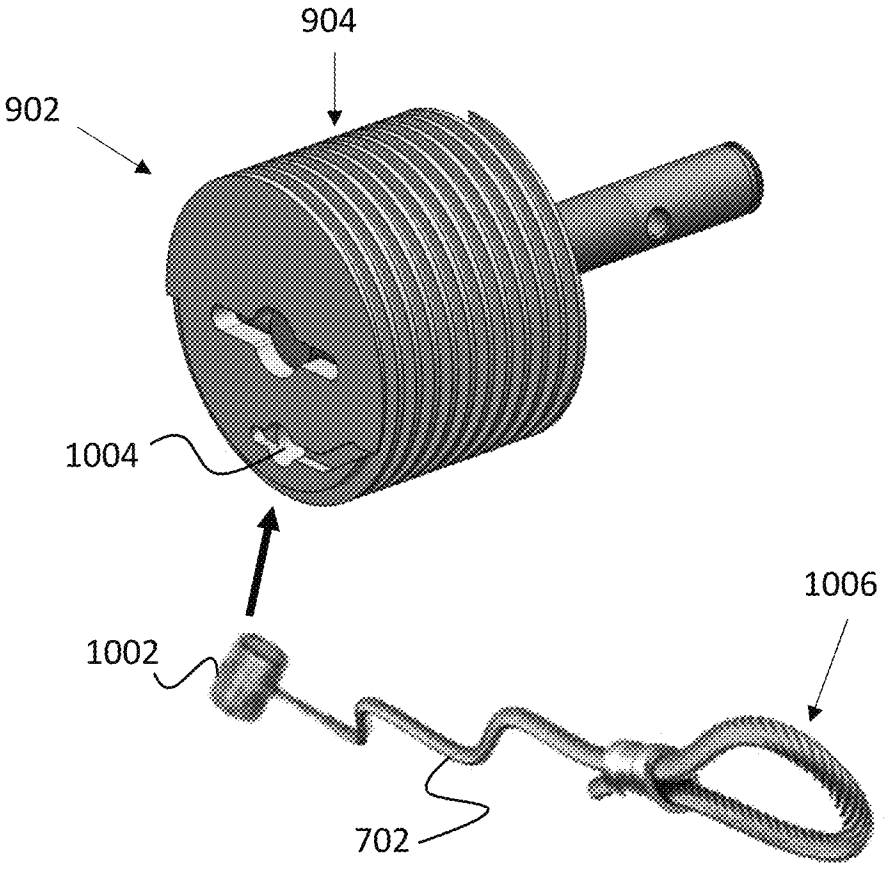
FIG. 10 is an exploded view of the umbrella cord winding structure of the umbrella cord retraction/extension structure of FIG. 9 in accordance with the present invention.

FIG. 10 provides a perspective view of the umbrella cord winding structure 902 and illustrates one embodiment for coupling the distal end of the umbrella cord 702 to the umbrella cord winding structure 902. In this embodiment, the umbrella cord 702 is provided with a securing member 1002 at its distal end. The securing member 1002 fits within a seat 1004 located at a location within the umbrella cord winding structure 902. The location of the seat 1004 is selected so that upon a rotation of the umbrella cord winding structure 902, the umbrella cord 702 will fall within the helical grooves 904. Continued rotation of the umbrella cord winding structure 902 will cause the umbrella cord 702 to shortened, which in turn, will cause the proximal end 1006 to pull the ring 704 (shown in FIG. 7) upward along the support pole 104 (also shown in FIG. 7) and cause the underlying structure 701 (also shown in FIG. 7) of the umbrella to raise and open.

Figure 11:
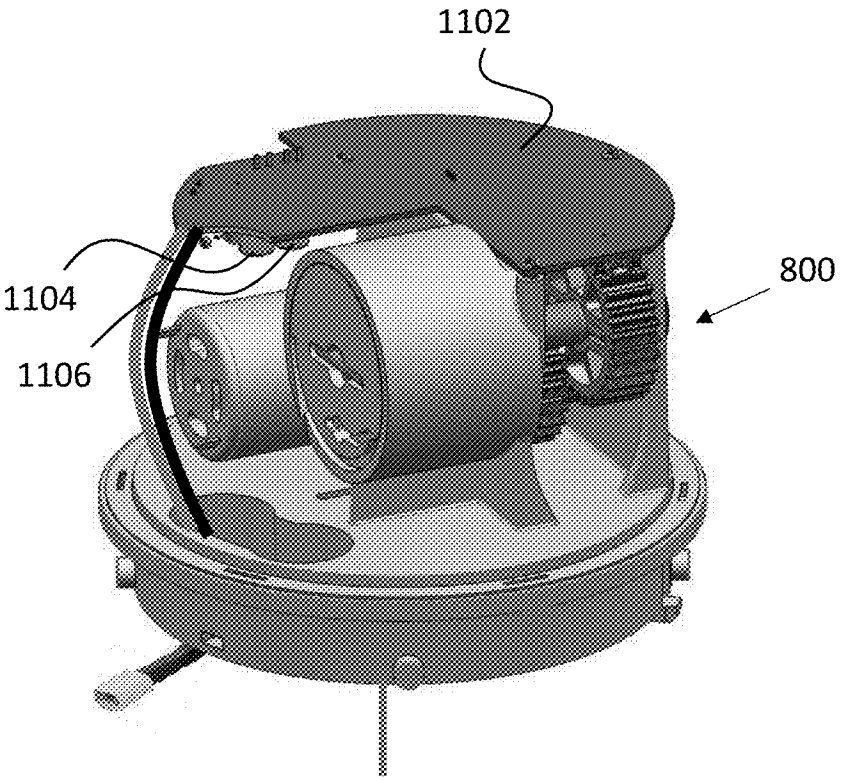
FIG. 11 is a downward-looking perspective view of a circuit board and the umbrella cord length control unit of the control head of FIG. 4 with the housing removed, in accordance with an embodiment of the present invention.

FIG. 11 shows a circuit board 1102 located on top of the umbrella cord length control unit 800, although it can be located in other places along the umbrella. Placing it in a location as far toward the distal/upper end of the umbrella is advantageous, as the circuit board 1102 includes a wireless receiver 1104 operable to receive wireless signals transmitted by a wireless transmitter and cause the umbrella cord length control unit 800 to alter the length of the umbrella cord 702 upon wirelessly receiving an instruction to do so. The wireless receiver 1104 can be any receiver capable or receiving wireless, e.g., RF, signals and can interpret one or more wireless protocols, e.g., BLUETOOTH, and other. The interpretation is performed by one or more electronic decoders 1106 communicatively coupled to the wireless receiver 1104. The decoder 1106 can interpret wireless signals and detect the presence of a code within a wireless communication transmission. The decoder 1106 is also communicatively coupled to the umbrella cord length control unit 800. When a predesignated and authorized code is detected, the decoder 1106 communicates with the umbrella cord length control unit 800 and causes the umbrella cord length control unit 800 to shortening or lengthen the length of the umbrella cord 702, as needed. More specifically, as just one exemplary application, a hotel may have an array of wirelessly controllable umbrellas located around its pool, upon the beach, or other places. Each one of the umbrellas within the array of wirelessly controllable umbrellas can be operated by a unique code. Each umbrella can be operated using a software application from anywhere in the word by use of the hub. That is, the "master" does not need to be in area of umbrellas. Each guest can either purchase or be given the code(s) to one or more umbrellas. Through some electronic application, e.g., a phone app, a tablet app, a kiosk, or any other, the guest can enter the unique code that will activate one umbrella within the array of wirelessly controllable umbrellas. This has a number of advantages. First, it allows guests to activate only their umbrella and they can do so electronically through the present invention, namely the umbrella cord length control unit 800. No longer is it necessary for a guest to manually pull on the cord or turn a crank handle. It also allows hotels to restrict umbrella use to only those that are authenticated. Furthermore, the hotel can have a master code or can send out at the same time or nearly the same time all of the unique codes in order to activate all umbrellas at once, e.g., close them all for the evening or close them if a storm is approaching.

Figure 12:
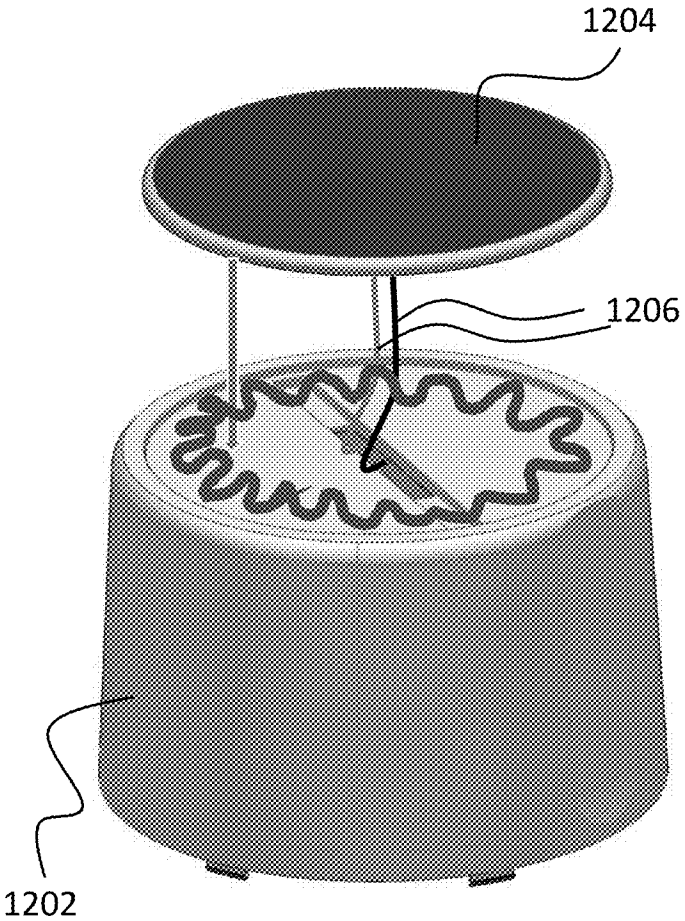
FIG. 12 is an exploded downward-looking perspective view of the housing of the control head of FIG. 4 showing a solar panel electrically coupled to the control head of FIG. 4, in accordance with an embodiment of the present invention.

Turning now to FIG. 12, an outer cover 1202 is shown, which can be used to cover and protect all of the components shown in FIG. 11. The outer cover 1202 also includes and supports a solar panel 1204 which includes a set of wires 1206 that passed through the outer cover 1202 and into the interior of the outer cover 1202. The solar panel 1204 is operable to receive and collect solar energy/power from the sun and other light sources. Solar panels are well known in the art and the details of which are not provided here.

Figure 13:
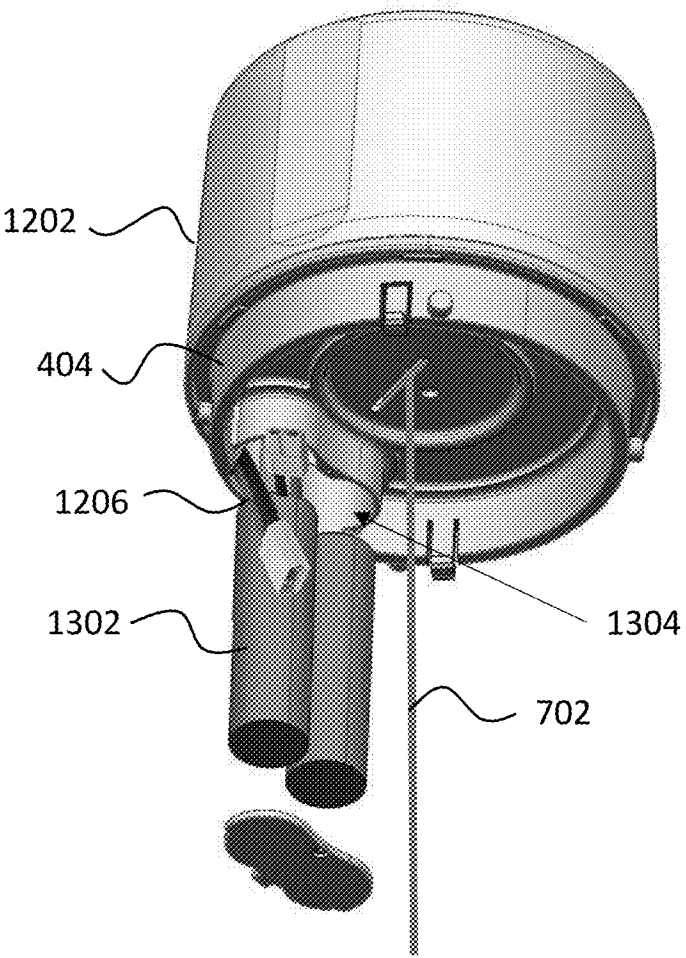
FIG. 13 is an exploded upward-looking perspective view of the control head of FIG. 4 showing a power source electrically coupled to the control head of FIG. 4, in accordance with an embodiment of the present invention.

FIG. 13 shows an upward-looking perspective view of the outer cover 1202 and underside of the gear platform 404. The gear platform 404 includes an opening 1304 that is shaped and sized to receive a power source 1302, e.g., one or more batteries, that are electrically coupled to and operable to supply power to the umbrella cord length control unit 800 when needed. The wires 1206 couple the power source 1302 to the solar panel 1204 so that the solar panel 1024 is able to collect solar energy and store it in the power source 1302. Because the unit is intended to be atop an umbrella, it will be in the sun most of the time and will advantageously be exposed to the sun all or a majority of the day.

Figure 14:
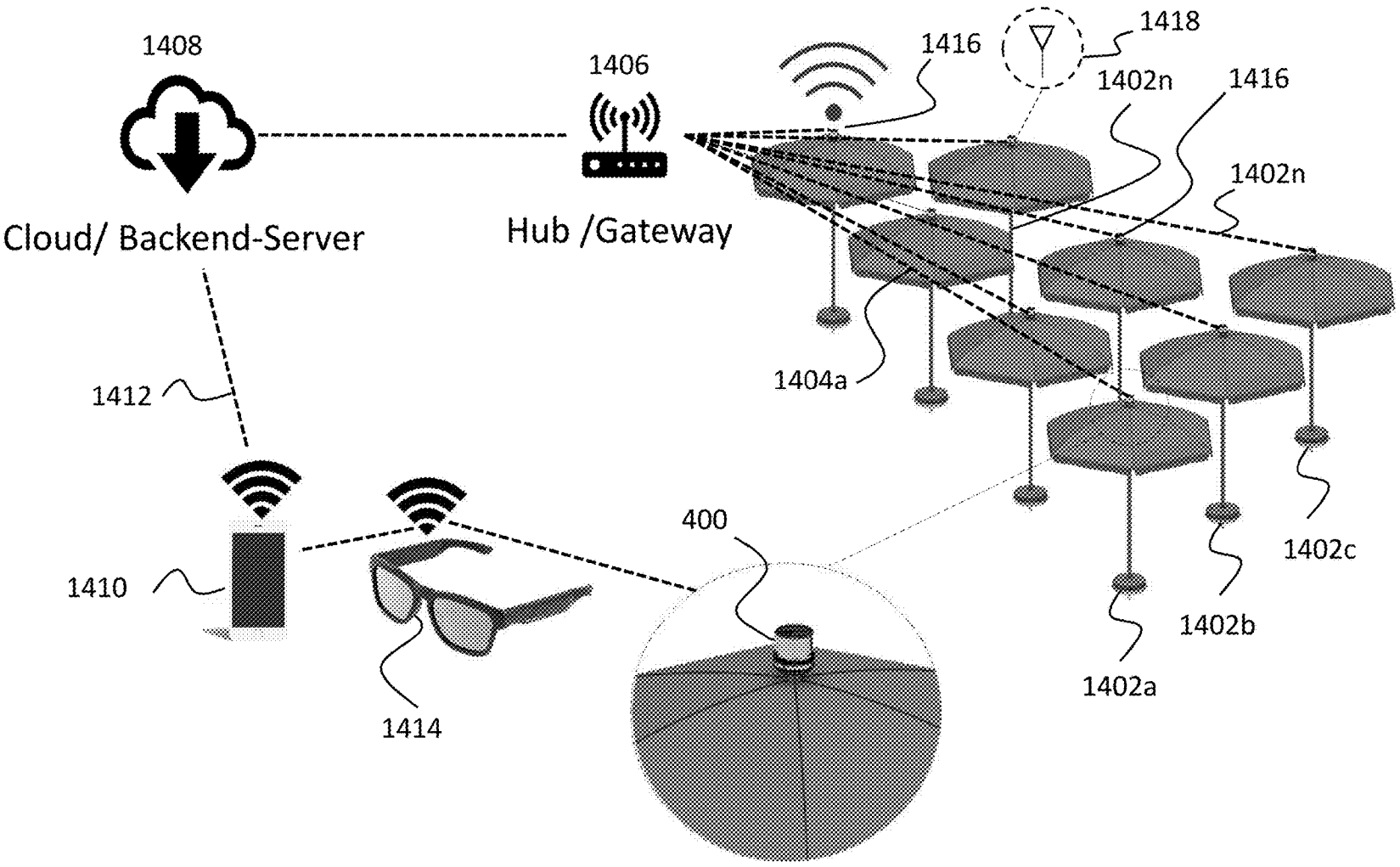
FIG. 14 provides a diagrammatical exemplary view of an array of wireless umbrellas in communication with a wireless network and wireless communication devices, in accordance with an embodiment of the present invention.

FIG. 14 shows an array 1400 of wirelessly controllable umbrellas 1402*a-n* (n equals any number greater than a). In one embodiment of the present invention, one or more of the umbrellas 1402*a-n* are equipped with control heads 400. The array 1400 includes a wireless transceiver 1406, which wirelessly communicates with the control heads 400 through two-way wireless links 1404*a-n*. The wireless transceiver 1406 can be an internet hub/gateway 1406 or any device that can transmit or receive across any type of communications network 1408. Examples of network types include the World Wide Web and the internet, either of which may be facilitated via various embodiments for radio communications such as a cellular communication network or any other wide area network (WAN), as well as local area networks (LANS), such as an Ethernet LAN. The network can also include a LoRaWAN network. LoRaWAN is a protocol designed for creating large-scale public networks; the technology allows for sensors, such as Internet of Things objects, to talk to the internet without 3G or WiFi. Community crowdsourced projects, and aims to provide access to this technology by deploying gateways globally that others can freely connect to. The network 1408 is not limited to any particular system and method of data communication and may combine any type of system and method for facilitation of data across the network 600.

A wireless mobile device 1410, such as a smart phone, can be used to communicate with one or more of the control heads 400 through a communication link that includes the internet 1408 and a wired connection to a wireless transmitter 1406, e.g., a wireless access point. A wireless access point is a networking hardware device that allows other Wi-Fi devices to connect to the wired network. The wireless transmitter 1406 can be connected to a router (via a wired network) as a standalone device, or it can also be an integral component of the router itself.

In another embodiment a wireless device, such as device 1414 can be used to communicate with one or more of the control heads 400. In this embodiment, device 1414 can be an Internet capable device, which will communicate with one or more control heads 400 through a communication link that includes the internet 1408 and the wireless transmitter 1406. Alternatively, device 1414 can facilitate a direct connection, e.g., Bluetooth, with the wireless transmitter 1406 or with one or more of the control heads 400, or both. In this way, a user using device 1414 can control one of the umbrellas 1402*a-n* even if an Internet connection is not available. A pair of sunglasses are illustrated as an example of an embodiment of an alternative wireless device 1414. In this embodiment, the glasses 1414 can be provided with a user input, such as a button, that, when pushed, will wirelessly connected, e.g., via BLUETOOTH protocol, to the umbrellas 1420 and activate the control head 400 to open or close the umbrella 1402.

In one embodiment, each umbrella 1402*a-n* is provided with a transceiver 1416 that is operable to report at least one condition, including at least an open status of the umbrella, i.e., whether the umbrella is opened or closed. In this way, one or more of the umbrellas 1402*a-n* can automatically report their status to a central communication hub, e.g., a computer run by a hotel, so that the hotel knows that all the umbrellas had been closed for the night or that an unauthorized user has opened an umbrella.

Furthermore, each umbrella 1402*a-n* can be provided with a wireless repeater 1418, which is a transceiver that takes an existing signal from the wireless router or wireless access point 1406 and rebroadcasts it to create a second network. When two or more umbrellas 1402 have to be connected with one another, for example, over the IEEE 802.11 protocol, and the distance is too long for a direct connection to be established, the wireless repeater 1418 can be used to bridge the gap. Here, the wireless repeater in, for instance, a first umbrella 1402*a*, transmits a signal received by the first umbrella 1402*a* to a second umbrella 1402*b*. The second umbrella 1402*b* can then transmit the signal received from the first umbrella 1402*a* to a third umbrella 1402*c*, and on and on. In this way, the wireless repeater is operable to facilitate an internet connection for one or more wireless communication devices 1410 proximate to the array of umbrellas 1400 through this new "repeated" network. The repeater 1418 can be part of the control head 400 or can be a specialized stand-alone computer networking device coupled to the control head 400.

Figure 15:
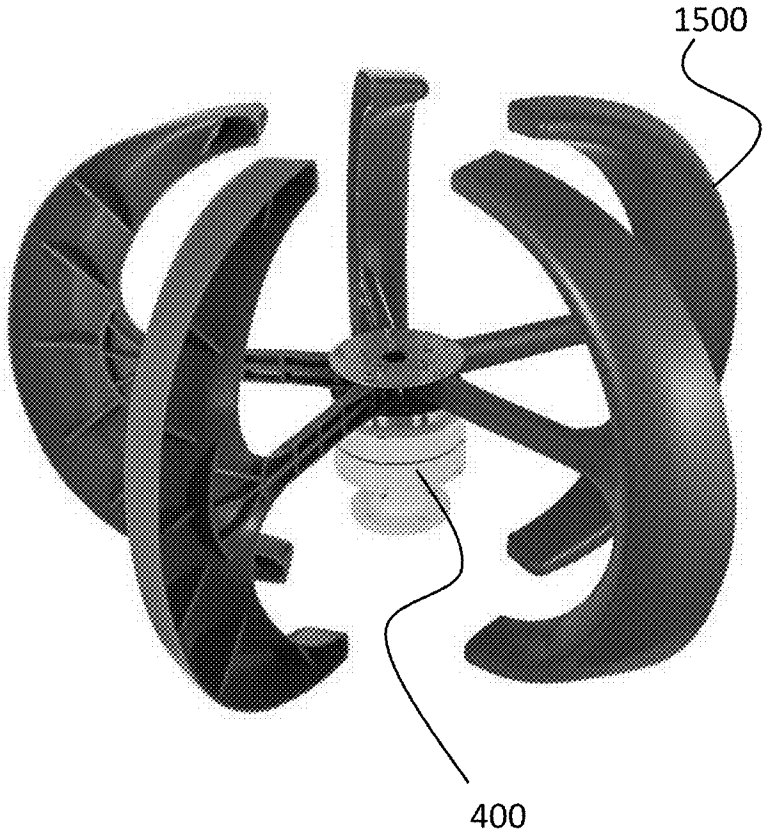
FIG. 15 is a downward-looking perspective view of a wind turbine capable of supplying power to the control head of FIG. 4, in accordance with an embodiment of the present invention.

FIG. 15 shows an alternative power generator to the solar panel 1204 of FIG. 11. In this embodiment, the power generator is a wind turbine 1500 that is electrically coupled to and operable to supply power to the power source 1302 shown in FIG. 13. A wind turbine, or alternatively referred to as a wind energy converter, is a device that converts the wind's kinetic energy into electrical energy. The wind turbine 1500 can be manufactured in a wide range of vertical and horizontal axis and sizes depending on the desired power generation needs for the application. It can be in addition to or a complete alternative replacement for the solar panel 1204. Small turbines are well known in the art and are used for numerous applications that require battery charging where a connection to traditional power grid is unavailable.

The wind turbine 1500 or any other device that is able to sense wind gusts can be used to cause the umbrella cord length control unit 400 that is coupled to the at least one of the array of umbrellas 1402*a-n* to alter the length of the umbrella cord 702 when a wind gust above a predetermined level is detected. This function of the umbrellas 1402*a-n* prevents the umbrellas 1402*a-n* from being so susceptible to damage by high winds. This is chiefly because the control unit 400 can close them and, thereby, reduce their wind resistance area.

Figure 16:
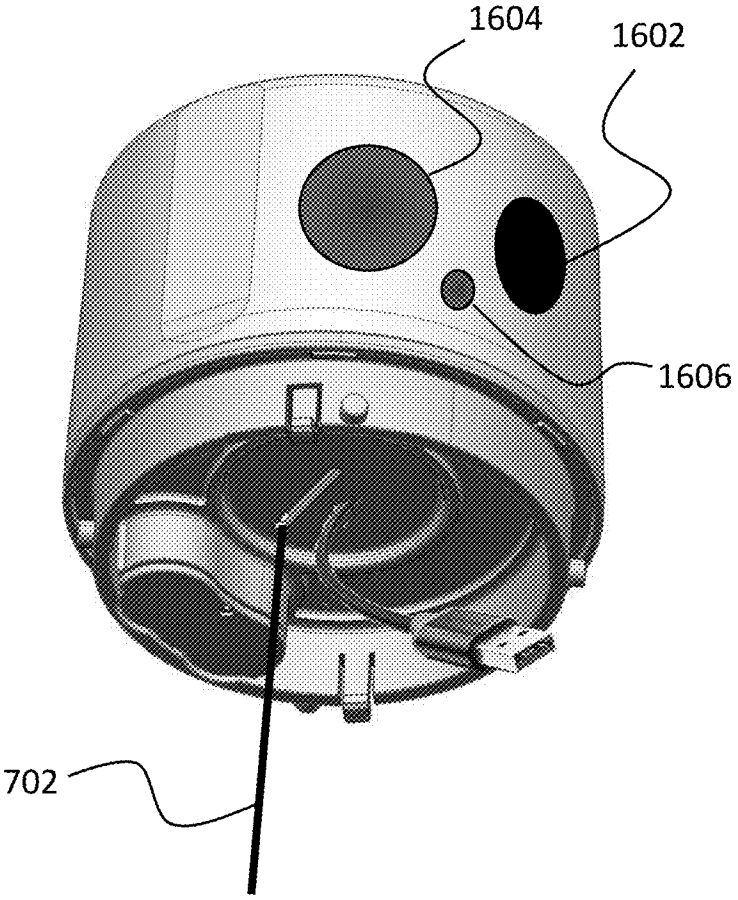
FIG. 16 is an upward-looking perspective view of the control head of FIG. 4, showing a camera, microphone, speaker, and communication/power/charging cable, in accordance with an embodiment of the present invention.

Turning now to FIG. 16, the retrofitting umbrella control head 400 is shown provided with a camera 1602. Inside the retrofitting umbrella control head 400 is a processor that is coupled to the camera 1602. The processor is operable to receive images captured by the camera 1602 and interpret them with a combination of software and hardware. Such image interpretation is well known in the art and will not be described in detail herein. The process is able to determine a match between an image captured by the camera 1602 and a pre-stored image of a person that is either stored in memory coupled to the retrofitting umbrella control head 400 or an image that is stored on the internet or other remotely accessible database. The processor is able to cause the umbrella cord length control unit 400 to alter the length of the umbrella cord 702 when a match between the image captured by the camera 1602 and the pre-stored image of the person is determined. This ability to identify (though the matching of the images) a person in front of the camera 1602 can have many uses. For example, in a hotel situation, the guest's picture can be taken at the time of registration and later used to identify that guests by the camera 1602. In this example, the guest merely needs to show his face to the camera 1602 and the umbrella 1402 will open for him or her. More it will begin accepting voice commands or remote-control commands, i.e., from the user's cell phone, once it confirms that the face belongs to a registered user. An alternative use of the camera 1602 could be to monitor employees. The cameras 1602 could keep a record of each time a particular employee came within a specified distance from each umbrella 1402. This would allow the owner of the umbrellas 1402 to ensure that its employees are properly servicing the guests utilizing the umbrellas 1402. Yet another use, the camera 1602 could be used to identify unauthorized users of the umbrellas 1402 or of the area upon which the umbrellas 1402 are placed. As just one specific example of this use, if a hotel guest has been permanently banned from the hotel, the cameras 1602 could be communicatively coupled to a database that includes a picture of the hotel guest. Once the camera 1602 captures that banned guest's face and matches it to the image in the database, it can then alert the hotel of the banned guest's location.

In some embodiments of the present invention, multiple cameras 1062 can also be provided to capture multiple users standing at multiple angles around the array of umbrellas 1402*a-n*. Those skilled in the art will recognize that businesses, municipalities, cities, counties, and the like, are all under extreme financial pressure affecting the level of service provided. By offering digital cameras 1062 as an integrated option inside the umbrellas 1402*a-n*, an immediate increase in service and safety can be realized at nominal cost.

Those skilled in the art are also aware that, aside from security and access reasons, facial recognition can be valuable for other purposes. The present invention may integrate facial recognition with advertising functions. One of the goals of advertising is to place content in front of the demographic that is most likely to be interested in the advertising content. For example, it does little good to place an ad for skateboards in front of persons over 60 years of age. On the other hand, displaying skateboard ads to males between the age of 10 and 18 would be very effective. Facial recognition can help place the correct advertisement content in front of the correct viewer. More specifically, the camera 1602 can be used to identify a type of a person. Images recorded by the camera 1602 can be run through facial recognition software to determine demographics of the person. For example, the face of a male can usually be readily distinguished from the face of a female. Instantly, certain types of ads can be eliminated and certain types of ads can be chosen to be instantly presented to a user of the umbrella 1402. Going further, an estimated age of the viewer can quickly be determined and certain ads can be eliminated and certain ads can be chosen based on the age of the viewer. It is possible to go even further, for example, determining ads based on race, types of clothing, contents of the person's hands, e.g., GUCCI purse, and other indicators of a person's interest. In one embodiment, the control head 400 includes a speaker 1604 that outputs sound. Advertisements or other announcements, e.g., warning of storms, notifications of expiring time under the umbrella, etc., can be audibly broadcast over the speaker 1604, as determined appropriate. In some embodiments, the speaker 1604 emits an audio signal towards the user and a microphone 1606 receives an audio signal, such as a command or response, from the user.

One exemplary advantageous use of the microphone 1606 and speaker 1604 would be to order food and refreshments verbally and remotely while located underneath the umbrella. More specifically, instead of the traditional method of an establishment sending the server to guests under the umbrella and asking them what they want and, hopefully, knowing when they want to be asked, with the present invention, the guest under the umbrella can simply state a command and communicate with the establishment. For example, the guest can order food and drinks or get the server's attention anytime they like. This would be particularly convenient if the guest had reserved the umbrella using a credit card or account number that is known by the establishment. They can then have all charges added to their master account and would not need to bring with them money or credit cards to the pool, beach, or wherever the umbrella is located, which is usually a location that does not have secure storage for money or credit cards.

Figure 18:
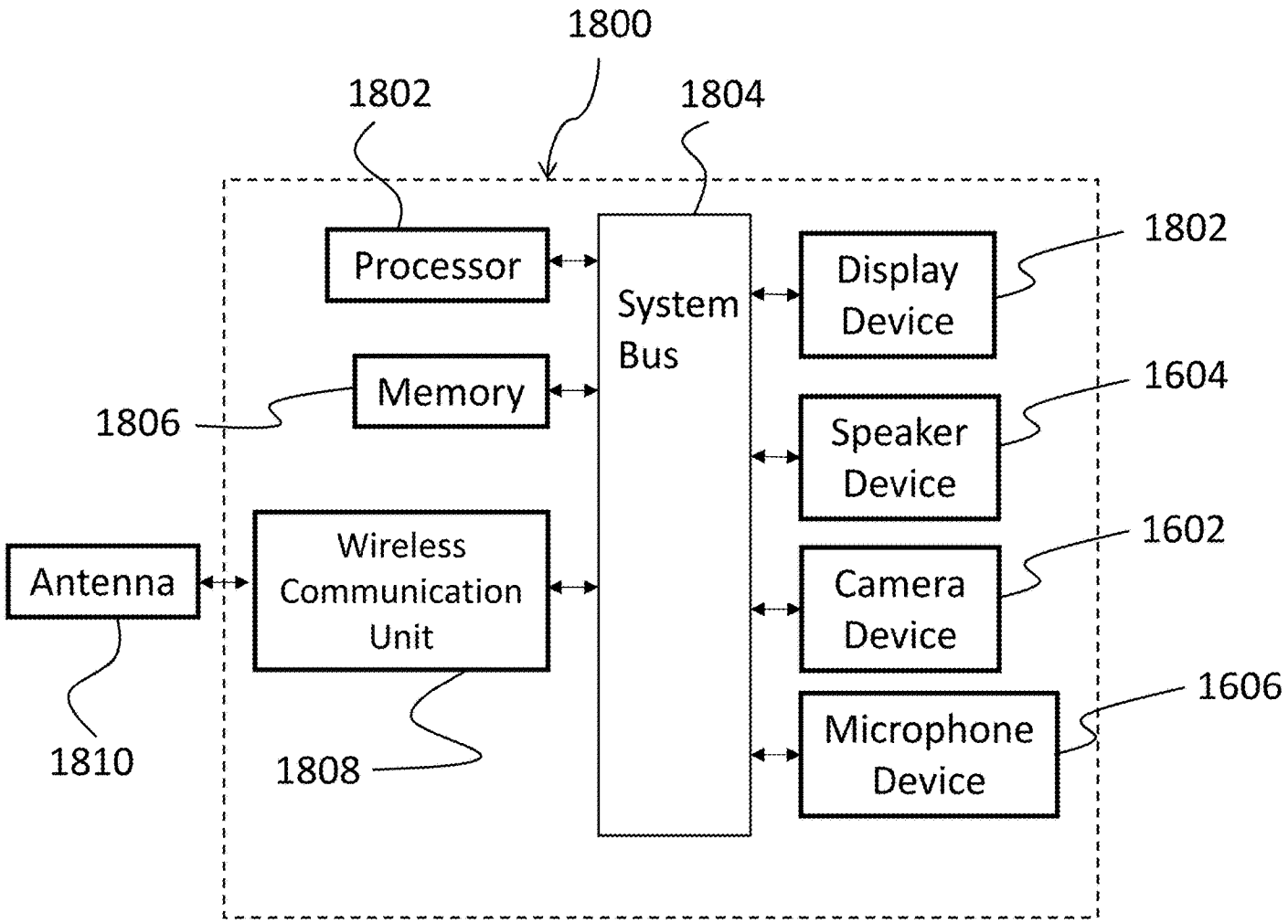
FIG. 18 is a block diagram of a processing and communication system of a control head within one or more wirelessly controllable umbrellas, in accordance with the present invention.

FIG. 18 is a block diagram of processing and communication system of the control head 400. The processing and communication system 1800 includes a processor 1802 for processing digital data. The components of the wireless communication device may be interconnected via a system bus 1804 or other known methods of interconnecting device components. The processor 1802 communicates through the bus 1804 to control data storage in a memory module 1806.

The processor 1802 can also control the speaker 1604, the camera 1602, and the microphone 1606, which are all connected through the system bus 1804. In one embodiment, the control head 400 is provided with a display device 1802 that display graphical information to a user. The display device 1802 can be a touchscreen that also receives data inputs from a user. Data in the memory 1806, for example, the amount of time left to use the umbrella without incurring an additional charge, can be caused by the processor 1802 to display information on the display device 1802, possibly in conjunction with audio being broadcast through the speaker 1604.

The processing and communication system 1800 also includes a wireless communication unit 1808 and an antenna 1810. The wireless communication unit 1808 and antenna 1810 form the transceiver 1416 (shown in FIG. 4) and operate in conjunction to transmit and receive wireless signals to and from other sources. The wireless exchange of digital information between the processing and communication system 1800 can be implemented via a network for wireless communication, such as any type of satellite, Wi-Fi, infrared, Near field communication, Bluetooth, or other communication networks.

Figure 19:
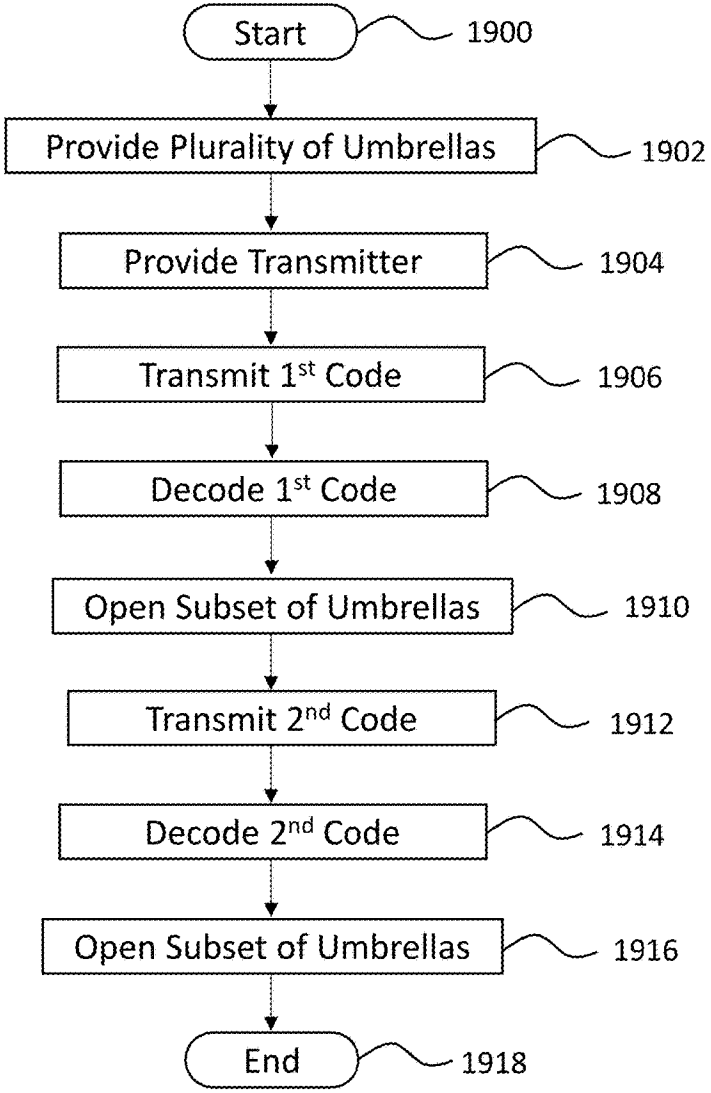
FIG. 19 is a flowchart diagram of a method of retrofitting an umbrella in accordance with the present invention.

FIG. 19 provides a process flow chart illustrating the steps of retrofitting an umbrella in accordance with the present invention. Although FIG. 19 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 19 for the sake of brevity. In some embodiments, some or all of the process steps included in FIG. 19 can be combined into a single process.

The method of activating an umbrella within an array of wirelessly controllable umbrellas starts with step 1900 in FIG. 19 and moves directly to step 1902 where a plurality of umbrellas is provided by a user. Each umbrella in the plurality of umbrellas includes a pole engagement member shaped and sized to couple to a distal end of an umbrella pole, an umbrella cord length control unit supported by the pole engagement member and operable to alter a length of an umbrella cord to open and close the umbrella, a wireless receiver operable to receive wireless signals transmitted by the wireless transmitter and cause the umbrella cord length control unit to alter the length of the umbrella cord upon wirelessly receiving an instruction to do so, a decoder coupled to the umbrella cord length control unit and operable to prevent the umbrella cord length control unit from shortening the length of the umbrella cord, a power source electrically coupled to and operable to supply power to the umbrella cord length control unit, and a solar energy collection panel electrically coupled to and operable to supply power to the power source. In step 1904, a wireless transmitter is provided to the system. In step 1906, the transmitter is used to transmit a first code to the wireless receiver of a first umbrella in the plurality of umbrellas. In the next step, 1908, a decoder in the first umbrella in the plurality of umbrellas decodes the first code. Next, in step 1910, the decoder causes the first umbrella in the plurality of umbrellas to move to an open position, i.e., blocks the sun, rain, etc. The first code does not affect other umbrellas in the plurality of umbrellas because the decoder in the other umbrellas do not recognize, i.e., are not able to decode the first code.

In step 1912, the transmitter transmits a second code, which is a different code from the first code. In step 1914, that second code is received by the wireless receiver of a second umbrella in the plurality of umbrellas and the decoder decodes the second code. The decoding step causes the second umbrella in the plurality of umbrellas to open in step 1916. The second code does not affect the first umbrella in the plurality of umbrellas because the decoder in the first umbrella in the plurality of umbrellas does not recognize, i.e., is not able to decode the second code. The process ends in step 1918.

A wirelessly controllable umbrella, which can be created by retrofitting existing umbrellas or by manufacturing a new one from scratch, has been disclosed. The wirelessly controllable umbrellas can be provided and will operate in arrays that are coordinated to all operate uniformly or each can be individually addressable. The wirelessly controllable umbrellas are self-powered and can facilitate a host of features and functions, as described herein.

Multifunctional end-node beach umbrellas have been disclose and, more particularly, umbrellas that are solar charged and battery operated and function as a single hub, which can be connected to a very large group of beach umbrellas through the use of an end-node beach umbrella controlling software, which enables them to open and close and can be monitored and controlled seamlessly, an unlimited number of beach umbrellas globally, automatically, and at the same time.

What is claimed is:

1. An array of wirelessly controllable umbrellas, the array comprising:

a wireless transmitter;

a plurality of umbrellas, each umbrella having:

a pole engagement member shaped and sized to couple to a distal end of an umbrella pole;

an umbrella cord length control unit supported by the pole engagement member and operable to alter a length of an umbrella cord to open and close the umbrella;

a wireless receiver operable to receive wireless signals transmitted by the wireless transmitter and cause the umbrella cord length control unit to alter the length of the umbrella cord upon wirelessly receiving an instruction to do so;

a power source electrically coupled to and operable to supply power to the umbrella cord length control unit; and a solar energy collection panel electrically coupled to and operable to supply power to the power source; and a first decoder coupled to a first umbrella in the plurality of umbrellas, the first decoder communicatively coupled to the umbrella cord length control unit of the first umbrella in the plurality of umbrellas and operable to prevent the umbrella cord length control unit of the first umbrella in the plurality of umbrellas from shortening the length of the umbrella cord unless a first predesignated code is received by the wireless receiver of the first umbrella in the plurality of umbrellas;

a second decoder coupled to a second umbrella in the plurality of umbrellas, the second decoder communicatively coupled to the umbrella cord length control unit of the second umbrella in the plurality of umbrellas and operable to prevent the umbrella cord length control unit of the second umbrella in the plurality of umbrellas from shortening the length of the umbrella cord unless a second predesignated code, that is different from the first predesignated code, is received by the wireless receiver of the second umbrella in the plurality of umbrellas; and a wireless repeater operable to transmit to other umbrellas within the array of umbrellas a copy of a signal received by the wireless receiver.

2. The array of wirelessly controllable umbrellas according to claim 1, further comprising:

a transmitter coupled to the first umbrella in the plurality of umbrellas and operable to report at least one condition, including at least an open status of the umbrella.

3. The array of wirelessly controllable umbrellas according to claim 1, wherein:

the wireless transmitter is communicatively coupled to the internet and transmits signals initiated over the internet.

4. The array of wirelessly controllable umbrellas according to claim 1, wherein:

the wireless repeater is operable to facilitate an internet connection for one or more wireless communication devices proximate to the array of umbrellas.

5. The array of wirelessly controllable umbrellas according to claim 1, further comprising:

a wind turbine electrically coupled to and operable to supply power to the power source.

6. The array of wirelessly controllable umbrellas according to claim 1, further comprising:

a camera coupled to at least one of the plurality of umbrellas;

a processor coupled to the camera and operable determine a match between an image captured by the camera and a pre-stored image of a person.

7. The array of wirelessly controllable umbrellas according to claim 6, wherein:

the processor is operable to cause the umbrella cord length control unit that is coupled to the at least one of the plurality of umbrellas to alter the length of the umbrella cord when a match between the image captured by the camera and the pre-stored image of the person is detected.

8. The array of wirelessly controllable umbrellas according to claim 1, further comprising:

a wind detector operable sense wind gusts and cause the umbrella cord length control unit that is coupled to the at least one of the plurality of umbrellas to alter the length of the umbrella cord when a wind gust above a predetermined level is detected.

9. A method of activating an umbrella within an array of wirelessly controllable umbrellas, the method comprising:

providing:

a plurality of umbrellas, each umbrella having:

a pole engagement member shaped and sized to couple to a distal end of an umbrella pole;

an umbrella cord length control unit supported by the pole engagement member and operable to alter a length of an umbrella cord to open and close the umbrella;

a wireless receiver operable to receive wireless signals transmitted by the wireless transmitter and cause the umbrella cord length control unit to alter the length of the umbrella cord upon wirelessly receiving an instruction to do so;

a decoder coupled to the umbrella cord length control unit and operable to prevent the umbrella cord length control unit from shortening the length of the umbrella cord;

a power source electrically coupled to and operable to supply power to the umbrella cord length control unit; and a solar energy collection panel electrically coupled to and operable to supply power to the power source; and a wireless transmitter; and transmitting via the wireless transmitter a first code that is received by the wireless receiver of a first umbrella in the plurality of umbrellas;

decoding by the decoder of the first umbrella in the plurality of umbrellas the first code;

causing the first umbrella in the plurality of umbrellas to open;

transmitting via the wireless transmitter a second code that is different from the first code and is received by the wireless receiver of a second umbrella in the plurality of umbrellas;

decoding by the decoder of the second umbrella in the plurality of umbrellas the second code; and causing the second umbrella in the plurality of umbrellas to open.

10. The method according to claim 9, further comprising the steps of:

reporting, with a first transmitter coupled to the first umbrella in the plurality of umbrellas, at least one condition of the first umbrella, including at least an open status of the first umbrella; and reporting, with a second transmitter coupled to the second umbrella in the plurality of umbrellas, at least one condition of the second umbrella, including at least an open status of the second umbrella.

11. The method according to claim 9, wherein:

the wireless transmitter is communicatively coupled to the internet and transmits signals initiated over the internet.

12. The method according to claim 9, further comprising the step of:

transmitting, by a first umbrella within the plurality of umbrellas, a copy of the wireless signals transmitted by the wireless transmitter to at least a second umbrella within the plurality of umbrellas.

13. The method according to claim 12, further comprising the steps of:

providing a wireless repeater coupled to at least one umbrella in the array of umbrellas; and facilitating, through the at least one wireless repeater, an internet connection for one or more wireless communication devices proximate to the array of umbrellas.

14. The method according to claim 9, further comprising the step of:

coupling a wind turbine to at least one umbrella in the array of umbrellas, the wind turbine operable to supply power to the power source.

15. The method according to claim 9, further comprising the step of:

providing a camera coupled to at least one of the plurality of umbrellas;

providing a processor coupled to the camera; and determining with the processor a match between an image captured by the camera and a pre-stored image of a person.

16. The method according to claim 15, further comprising:

causing the umbrella cord length control unit that is coupled to the at least one of the plurality of umbrellas to alter the length of the umbrella cord after the determining step.

17. The method according to claim 9, further comprising:

detecting, with a wind detector, wind gusts that exceed a predetermined threshold level; and causing the umbrella cord length control unit that is coupled to the at least one of the plurality of umbrellas to alter the length of the umbrella cord.

18. An umbrella control system, comprising:

a plurality of multifunctional end-node beach umbrellas, each one of the plurality of multifunctional end-node beach umbrellas including:

a pole engagement member at a distal end of an umbrella pole and an umbrella cord length control unit supported by the pole engagement member that controls a length of an umbrella cord to open and close the umbrella;

a wireless transceiver operable to transmit and receive wireless signals, and which is operably coupled to the umbrella cord length control unit, wherein the umbrella cord length control unit is responsive to a first code received by the wireless transceiver that is intended for the one of the plurality of multifunctional end-node beach umbrellas to change a length of the umbrella cord, and wherein the wireless transceiver is configured, upon receiving a second code intended for a different one of the multifunctional end-node beach umbrellas to retransmit the second code to another one of the plurality of multifunctional end-node beach umbrellas; and a hub configured to transmit the first and second codes to at least one of the plurality of multifunctional end-node beach umbrellas.

19. The umbrella control system of claim 18, further comprising:

wherein each one of the plurality of multifunctional end-node beach umbrellas is operable to report a condition of the one of the plurality of multifunctional end-node beach umbrellas to one of the hub and another one of the plurality of multifunctional end-node beach umbrellas.

20. An array of wirelessly controllable umbrellas, the array comprising:

a wireless transmitter;

a plurality of umbrellas, each umbrella having:

a pole engagement member shaped and sized to couple to a distal end of an umbrella pole;

an umbrella cord length control unit supported by the pole engagement member and operable to alter a length of an umbrella cord to open and close the umbrella;

a wireless receiver operable to receive wireless signals transmitted by the wireless transmitter and cause the umbrella cord length control unit to alter the length of the umbrella cord upon wirelessly receiving an instruction to do so;

a power source electrically coupled to and operable to supply power to the umbrella cord length control unit; and a solar energy collection panel electrically coupled to and operable to supply power to the power source; and a first decoder coupled to a first umbrella in the plurality of umbrellas, the first decoder communicatively coupled to the umbrella cord length control unit of the first umbrella in the plurality of umbrellas and operable to prevent the umbrella cord length control unit of the first umbrella in the plurality of umbrellas from shortening the length of the umbrella cord unless a first predesignated code is received by the wireless receiver of the first umbrella in the plurality of umbrellas;

a second decoder coupled to a second umbrella in the plurality of umbrellas, the second decoder communicatively coupled to the umbrella cord length control unit of the second umbrella in the plurality of umbrellas and operable to prevent the umbrella cord length control unit of the second umbrella in the plurality of umbrellas from shortening the length of the umbrella cord unless a second predesignated code, that is different from the first predesignated code, is received by the wireless receiver of the second umbrella in the plurality of umbrellas;

a camera coupled to at least one of the plurality of umbrellas; and a processor coupled to the camera and operable determine a match between an image captured by the camera and a pre-stored image of a person.

* * * * *